US011788445B2

(12) United States Patent
Griffin et al.

(10) Patent No.: US 11,788,445 B2
(45) Date of Patent: Oct. 17, 2023

(54) FLUID DRAIN SYSTEM

(71) Applicant: Cummins Inc., Columbus, IN (US)

(72) Inventors: Jason R. Griffin, Greenwood, IN (US); Ajit R. Pawar, Columbus, IN (US); Norberto Nunes, Columbus, IN (US); Glen R. Alden, Seymour, IN (US); Mathias Kemnitzer, Columbus, IN (US)

(73) Assignee: Cummins Inc., Columbus, IN (US)

( * ) Notice: Subject to any disclaimer, the term of this patent is extended or adjusted under 35 U.S.C. 154(b) by 187 days.

(21) Appl. No.: 17/295,738

(22) PCT Filed: Dec. 12, 2018

(86) PCT No.: PCT/US2018/065173
§ 371 (c)(1),
(2) Date: May 20, 2021

(87) PCT Pub. No.: WO2020/122893
PCT Pub. Date: Jun. 18, 2020

(65) Prior Publication Data

US 2022/0010704 A1 Jan. 13, 2022

(51) Int. Cl.
*F01M 11/04* (2006.01)

(52) U.S. Cl.
CPC ..... *F01M 11/0408* (2013.01); *F01M 11/0458* (2013.01); *F01M 2011/0416* (2013.01)

(58) Field of Classification Search
CPC ..... F01M 2001/0416; F01M 11/0458; F01M 11/0408
See application file for complete search history.

(56) References Cited

U.S. PATENT DOCUMENTS 1,954,986 A * 4/1934 Carlson ..... F01M 11/0408 251/253
4,773,169 A * 9/1988 Vinas ..... D06B 15/10 34/313

(Continued)

FOREIGN PATENT DOCUMENTS

WO 2010025476 3/2010

OTHER PUBLICATIONS

International Search Report and Written Opinion issued by the ISA/US, dated Mar. 8, 2019, for International Application No. PCT/US2018/065173; 6 pages.

(Continued)

*Primary Examiner* — Michael A Riegelman
(74) *Attorney, Agent, or Firm* — Faegre Drinker Biddle & Reath LLP

(57) ABSTRACT

A fluid drain system is provided, comprising: a fluid reservoir having at least two sumps including a first sump having a first hole for draining fluid from the fluid reservoir and a second sump having a second hole for draining fluid from the fluid reservoir; a first drain plug having a first end with a first drive feature configured to be operated with a tool for insertion and removal of the first drain plug into and out of the first hole of the fluid reservoir and a second end with a second drive feature; and a second drain plug having a first end with a third drive feature configured to be engaged by the second drive feature of the first drain plug for insertion and removal of the second drain plug into and out of the second hole of the fluid reservoir.

21 Claims, 9 Drawing Sheets

(56) References Cited

U.S. PATENT DOCUMENTS 5,214,985 A * 6/1993 Rinehart ..... B25B 13/48 81/176.15
6,050,867 A * 4/2000 Shields ..... B63B 13/02 440/88 L
6,485,242 B1 * 11/2002 Kikawa ..... F16B 43/001 411/369
7,357,225 B2 * 4/2008 Dorian ..... F01M 11/0408 184/105.3
8,281,896 B2 * 10/2012 Morgan ..... F01M 11/0408 184/1.5
8,418,812 B1 * 4/2013 Rosen ..... F01M 11/04 411/371.1
8,875,933 B2 * 11/2014 Griffiths ..... F01M 11/0408 220/601
9,303,539 B1 * 4/2016 Peirce ..... F01M 11/0408
10,001,039 B2 * 6/2018 Shin ..... F01M 11/0408
11,015,495 B2 * 5/2021 Lee ..... F01M 11/0408
2007/0170390 A1 * 7/2007 Jessberger ..... F01M 11/0408 251/215
2008/0099080 A1 * 5/2008 Saini ..... F01M 11/0408 184/1.5
2011/0197349 A1 * 8/2011 Lee ..... F01M 11/0408 4/295
2016/0130995 A1 * 5/2016 England ..... F01M 11/0004 184/1.5
2022/0010704 A1 * 1/2022 Griffin ..... F01M 11/0408

OTHER PUBLICATIONS

International Preliminary Report on Patentability received for PCT Patent Application No. PCT/US2018/065173, dated Jun. 24, 2021, 6 pages.

* cited by examiner

FLUID DRAIN SYSTEM

CROSS-REFERENCE TO RELATED APPLICATIONS

The present application is a national stage application of International (PCT) Patent Application Serial No. PCT/US2018/065173, filed on Dec. 12, 2018, the complete disclosure of which is expressly incorporated by reference herein.

FIELD OF THE DISCLOSURE

The present disclosure relates to a fluid drain system for use in internal combustion engines such as, for example, diesel engines, and more particularly to a fluid drain system with one drain plug configured to be removed by a standard tool and another drain plug configured to be removed using the first drain plug.

BACKGROUND

Some engine applications require a fluid reservoir system with two separate sumps to hold lubricating fluid for the engine. Two sumps are necessary to have sufficient fluid capacity for the engine system while maintaining clearance from the vehicle's chassis in which the engine is installed.

During service events, a two sump system requires the service technician to drain each sump. After fluid is drained, a two sump fluid system can be overfilled because technicians can fail to drain both sumps. An overfilled fluid reservoir could cause damage to the engine. Therefore, there is a need for a fluid drain system which minimizes the likelihood that a technician will fail to drain all sumps of a fluid reservoir of an engine.

SUMMARY OF THE DISCLOSURE

In one embodiment of the present disclosure, a fluid drain system is provided, comprising: a fluid reservoir having at least two sumps including a first sump having a first hole for draining fluid from the fluid reservoir and a second sump having a second hole for draining fluid from the fluid reservoir; a first drain plug having a first end with a first drive feature configured to be operated with a tool for insertion and removal of the first drain plug into and out of the first hole of the fluid reservoir and a second end with a second drive feature; and a second drain plug having a first end with a third drive feature configured to be engaged by the second drive feature of the first drain plug for insertion and removal of the second drain plug into and out of the second hole of the fluid reservoir. In one aspect of this embodiment, one of the first sump and the second sump has a larger fluid capacity than the other of the first sump and the second sump. In another aspect, at least one of the first drain plug or second drain plug is made of metal. In yet another aspect, the tool is a standard hand tool, and the second drive feature has a shape that is different from a shape of the first drive feature and disposed opposite of the first end. In still another aspect, the second drive feature of the first drain plug has a shape selected from the group consisting of a triangle, an oval, a hexagon, an octagon, a pentagon, a logo, an alphanumeric character or numeral, and a mathematic symbol. In another aspect, the first drain plug has a first outer diameter, the second drain plug has a second outer diameter, and the first outer diameter is different from the second outer diameter. In a variant of this aspect, the first drain plug includes a body and the second drain plug includes a body, at least one of the first drain plug body and the second drain plug body having threads configured to mate with threads formed in a corresponding one of the first hole and the second hole. In still another aspect, the first hole has a first side wall having a first inner diameter, the second hole has a second side wall having a second inner diameter, and the first inner diameter is different from the second inner diameter. In a variant of this aspect, at least one of the first side wall and the second side wall includes threads configured to mate with threads of a corresponding one of the first drain plug and the second drain plug. Still another aspect of this embodiment further comprises a first marking on the first sump, and a second marking on the second sump, wherein the first marking and the second marking indicate an order for removal of the first drain plug and the second drain plug. Another aspect further comprises a first marking identifying the first sump, and a second marking identifying the second sump. In yet another aspect, the second end of the first drain plug includes side surfaces that protrude from a body of the first drain plug. In another aspect, the first drive feature is formed as a recess into the outer surface. In another aspect, one of the first drive feature, the second drive feature, or third drive feature is in the shape of a polygon having equal sides. In yet another aspect, one of the first drive feature, the second drive feature, or third drive feature is in the shape of a polygon having unequal sides. Another aspect of this embodiment further comprises a first pair of markings on the first sump; and a second pair of markings on the second sump; wherein the first pair of markings and the second pair of markings indicate an order for removal of the first drain plug and the second drain plug.

In another embodiment, the present disclosure provides a method for changing fluids held within a fluid reservoir having a first hole and a second hole, comprising: removing a first drain plug from the first hole of the reservoir; engaging the first drain plug with a first end of a second drain plug; and rotating the first drain plug while the first end of the first drain plug is engaged with the first end of the second drain plug to remove the second drain plug from the second hole of the reservoir. One aspect of this embodiment further comprises identifying a first marking and a second marking on the fluid reservoir and carrying out the removing, inserting and rotating according to information provided by the first marking and the second marking. In another aspect, removing the first drain plug includes inserting a standard hand tool into a drive feature formed on the first drain plug. In yet another aspect, engaging the first drain plug with a first end of the second drain plug includes inserting a drive feature formed at a first end of the first drain plug into a drive feature formed at the first end of the second drain plug. Another aspect further comprises draining fluid from the first hole and the second hole; rotating the first drain plug while the first drain plug is engaged with the first end of the second drain plug to insert the second drain plug into the second hole; disengaging the first drain plug from the first end of the second drain plug; and rotating the first drain plug while the first drain plug is disengaged from the first end of the second drain plug to insert the first drain plug into the first hole.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the disclosure and such exemplifications are not to be construed as limiting the scope of the disclosure in any manner.

DETAILED DESCRIPTION

Figure 1:
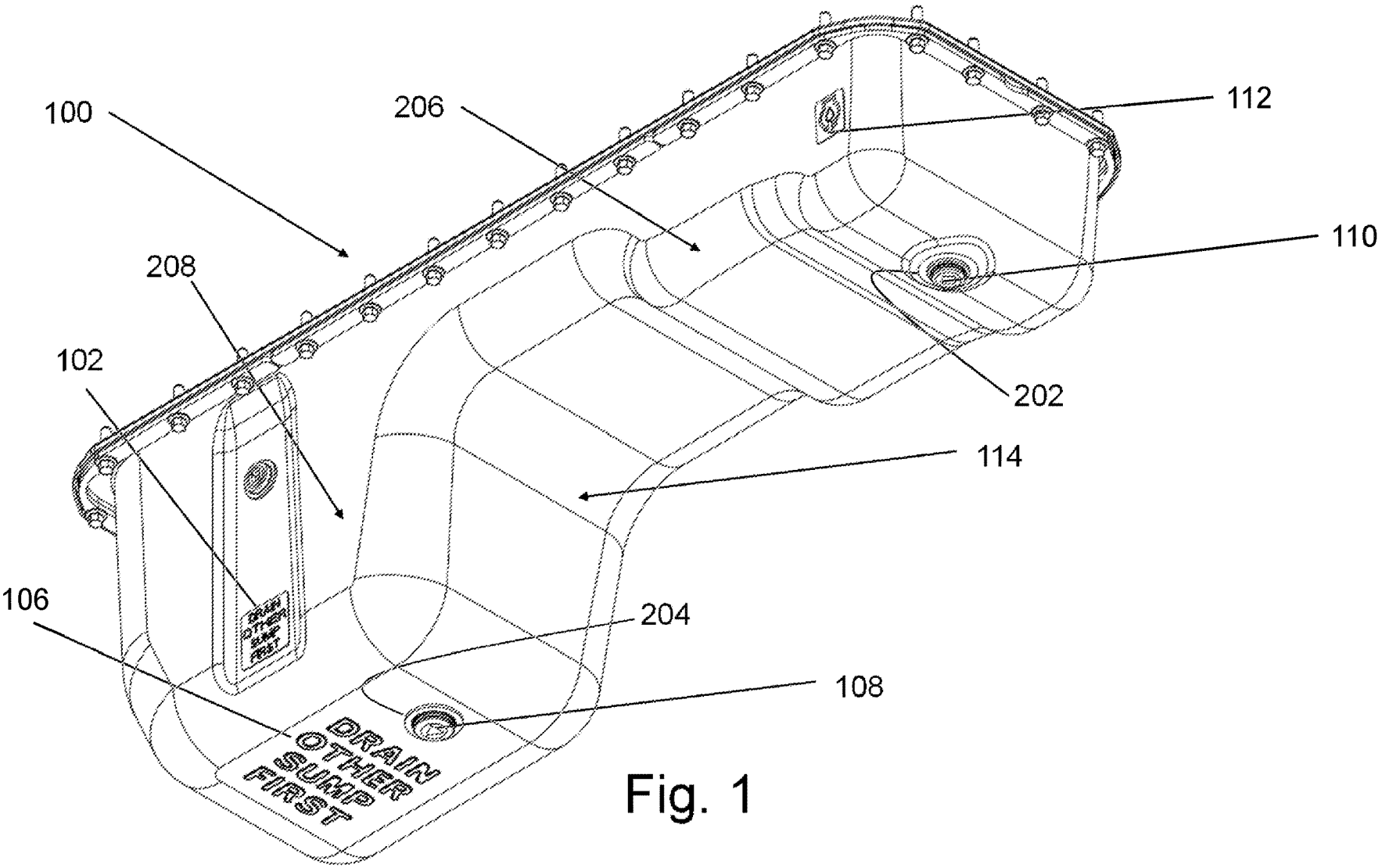
FIG. 1 is an isometric view of the fluid drain system in accordance with the present disclosure.

While the present invention is amenable to various modifications and alternative forms, specific embodiments have been shown by way of example in the drawings and are described in detail below. The present disclosure, however, is not limited to the particular embodiments described. On the contrary, the present disclosure is intended to cover all modifications, equivalents, and alternatives falling within the ambit of the present disclosure as defined by the appended claims.

With reference to FIG. 1, there is illustrated a fluid drain system 100. The fluid drain system 100 generally includes a fluid reservoir 114 having a first sump 206 and a second sump 208. First sump 206 includes a first fluid hole 202 configured to receive a first drain plug 110, and second sump 208 includes a second fluid hole 204 configured to receive a second drain plug 108. Fluid drain system 100 further includes markings 102, 112, and 106 to provide instruction to the operator to complete the operation of the fluid drain system 100. Duplicates of markings 112 and 102 are repeated on the other side of drain system 100 (not shown in FIG. 1).

Figure 2A:
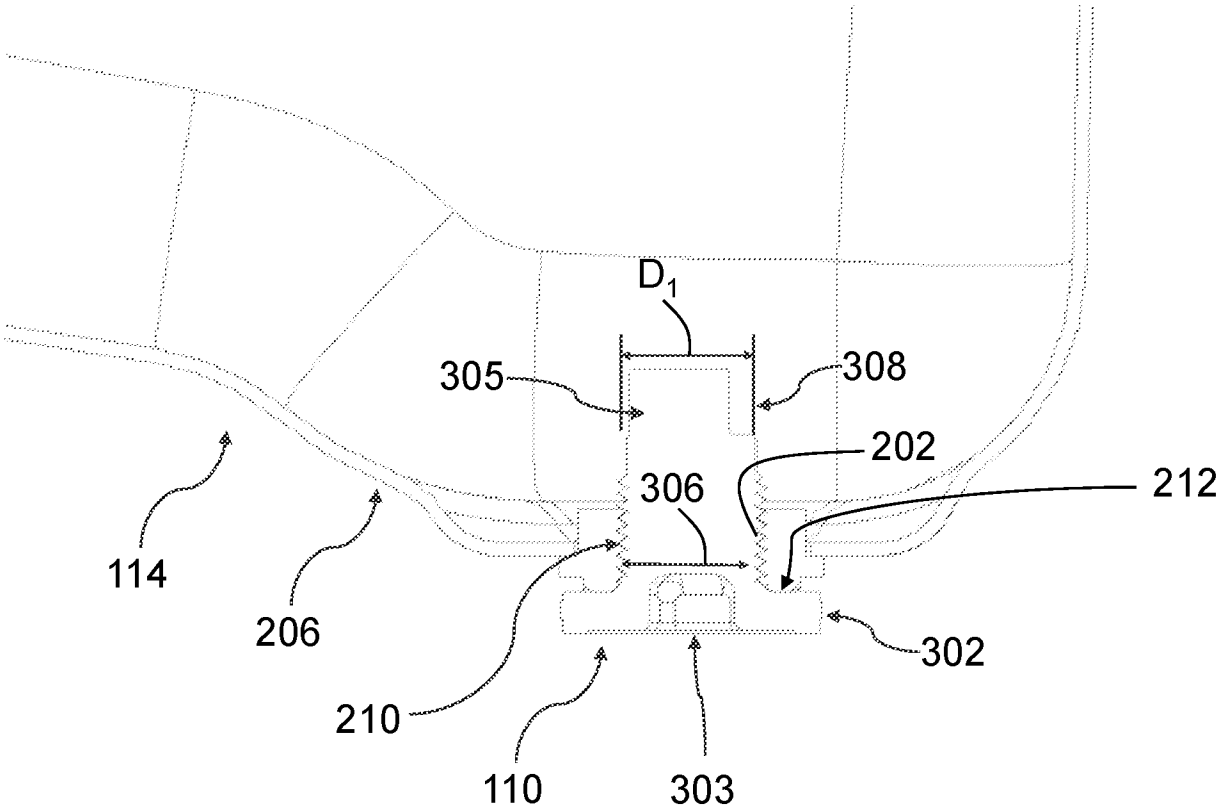
FIG. 2*a* is a cross-section view of the first sump of the fluid drain system as depicted in FIG. 1 in accordance with the present disclosure.
Figure 2B:
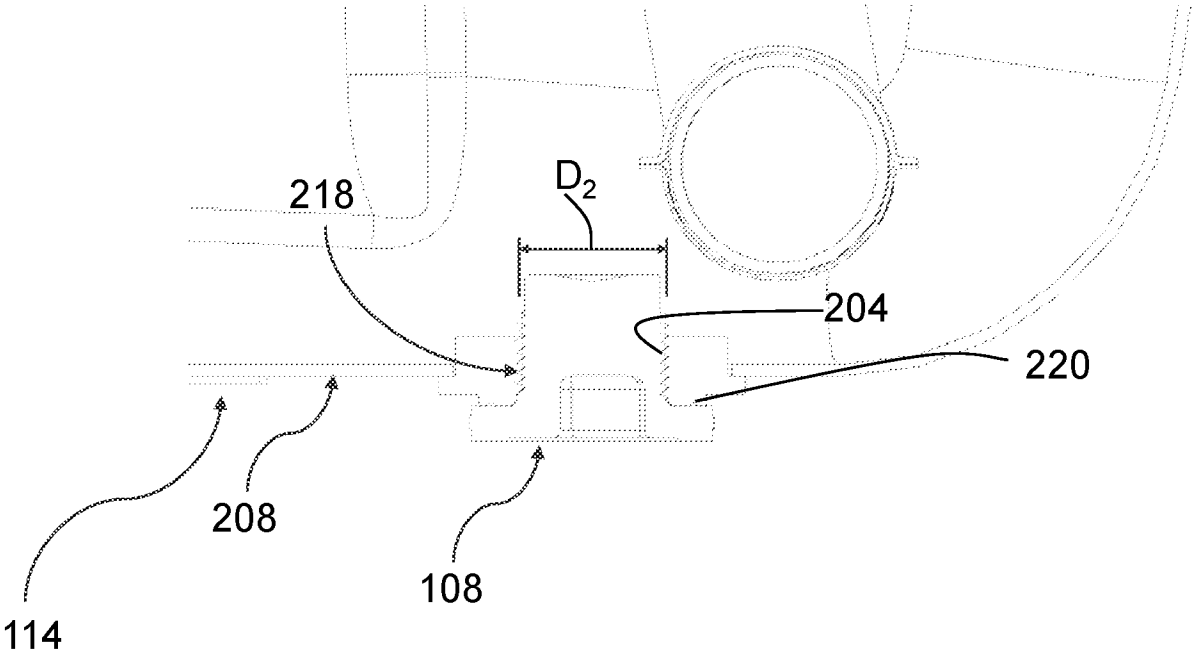
FIG. 2*b* is a cross-section view of the second sump of the fluid drain system as depicted in FIG. 1 in accordance with the present disclosure.

With reference to FIGS. 2*a* and 2*b*, first hole 202 has a first outer diameter $D_1$ and second hole 204 has a second outer diameter $D_2$ configured to be a different size than the first outer diameter $D_1$. The differences in diameter prevent use of first drain plug 110 in second hole 204 or second drain plug 108 in first hole 202. The first hole 202 is configured to receive the first fluid drain plug 110. The second hole 204 is configured to receive the second fluid drain plug 108. The fluid capacity of the first sump 206 may be higher, lower, or the same as the fluid capacity of the second sump 208.

In the present disclosure the reservoir 114 is made of metal, the first drain plug 110 is made of metal, or the second drain plug 108 is made of metal or all of the reservoir 114, the first drain plug 110, and second drain plug 108 are made of metal. However further embodiments could include the use of plastics, composites, or other materials.

Figure 3:
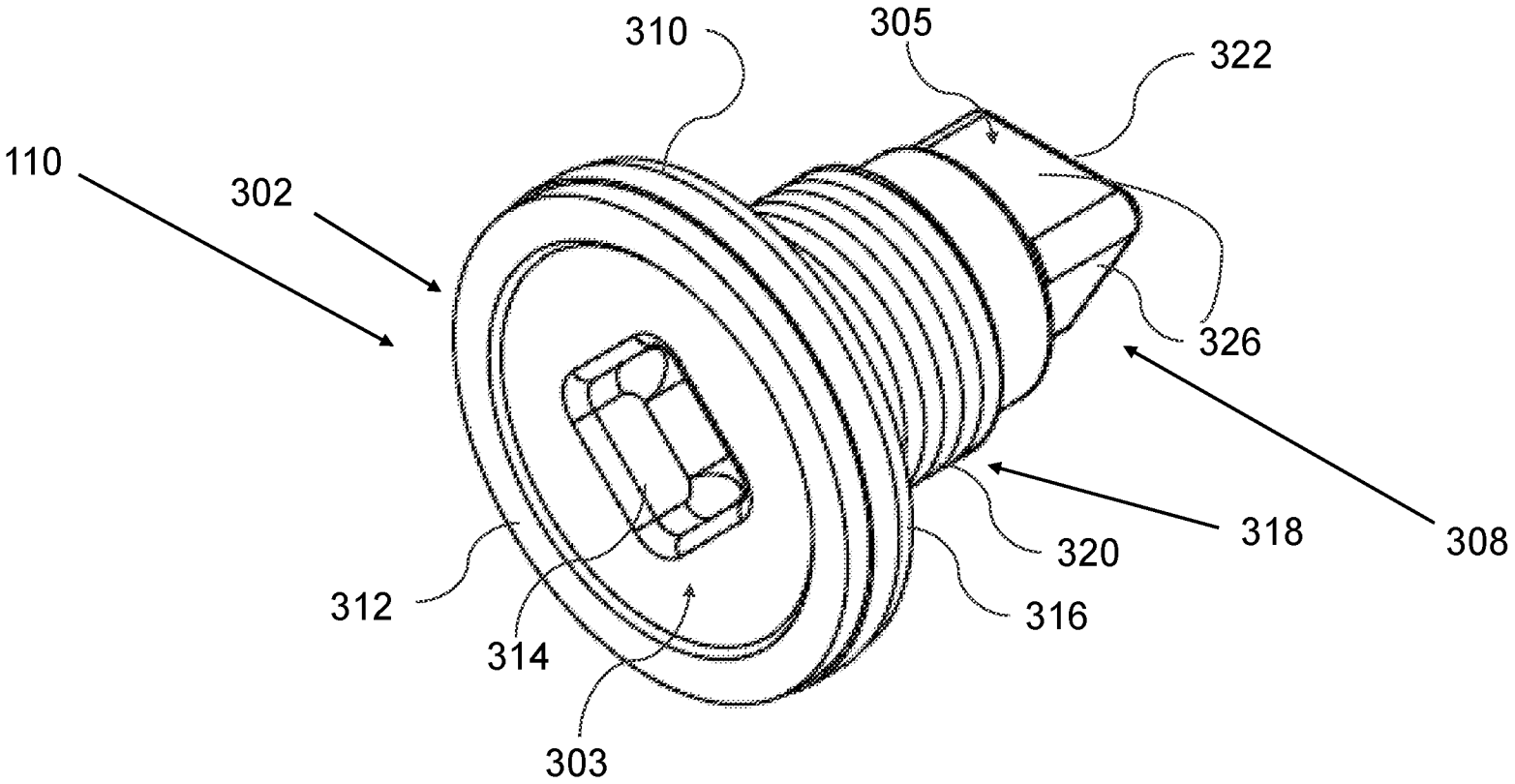
FIG. 3 is an isometric view of the first fluid drain plug in accordance with the present disclosure.
Figure 4:
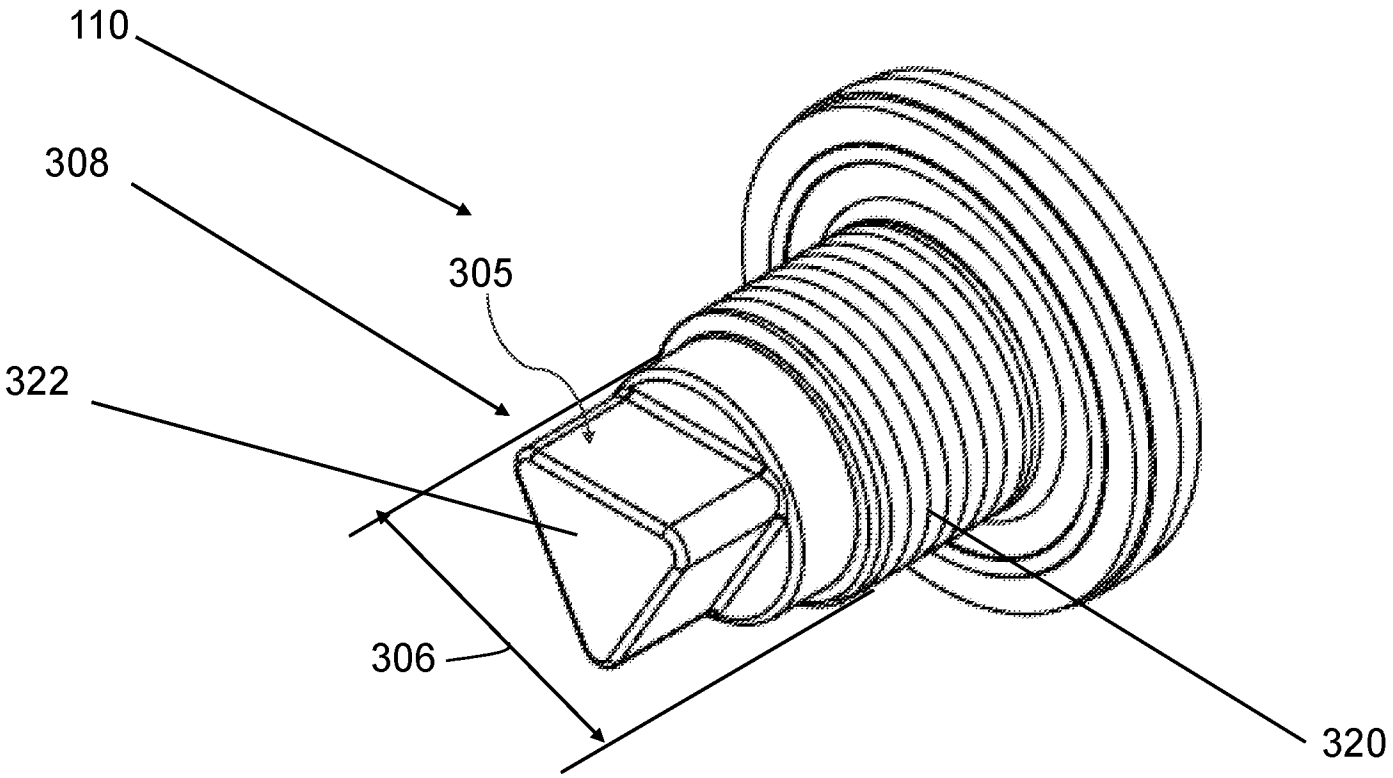
FIG. 4 is another isometric view of the first fluid drain plug depicted in FIG. 3.

With reference to FIGS. 3 and 4, there is illustrated the first fluid drain plug 110. The first fluid drain plug 110 has a first end 302 including a first drive feature 303 configured, in one embodiment, to be operated with a standard tool and a second end 308 including a second drive feature 305 configured to operate a second fluid drain plug 108. The first end 302 includes a flange 310 having an outer surface 312 and an inner surface 316. In the depicted embodiment, first drive feature 303 is formed as a recess into outer surface 312. Inner surface 316 is configured to abut an outer rim 212 of first hole 202 when first drain plug 110 is fully inserted into first hole 202. The standard tool to operate first drive feature 303 could be any commercial available tool such as a standard ratchet wrench. Such tools have ratchet drive sizes such as ⅜", ½", or ¾" size square-drive heads. In this embodiment, first drive feature 303 includes four drive surfaces 314 that are sized to receive a standard square drive head of a socket wrench. Other drive features may be used that protrude from outer surface 312 such as a standard hexagon shaped bolt head which could be operated by a commercially available wrench or socket. The first fluid drain plug 110 also has a body 318 having an outside diameter 306 which is substantially similar to diameter $D_1$ of first drain hole 202. Body 318 of first fluid drain plug 110 includes threads 320 which are sized to be threaded into corresponding threads 210 formed in first drain hole 202. Other embodiments may include different means of attaching the drain plug into the hole such as a press fit or adhesives.

In the depicted embodiment, second drive feature 305 of second end 308 of first fluid drain plug 110 is formed as a triangular protrusion. Specifically, second drive feature 305 includes three side surfaces 326 and a triangular end surface 322. It should be understood that in other embodiments, second drive feature 305 may have different shapes and may be formed as a recess within second end 308 of first fluid drain plug 110 or formed as a protrusion from second end 308. In any embodiment, second drive feature 305 is formed to have a shape that mates with a corresponding shape (male or female) formed in second fluid drain plug 108 as described below. While the second drive feature 305 of the first fluid drain plug 110 is depicted in the shape of a triangle, other embodiments may include any geometric shape such as an oval, pentagon, heptagon, octagon, a logo, alphanumeric character or numeral, or mathematic symbol.

Figure 5:
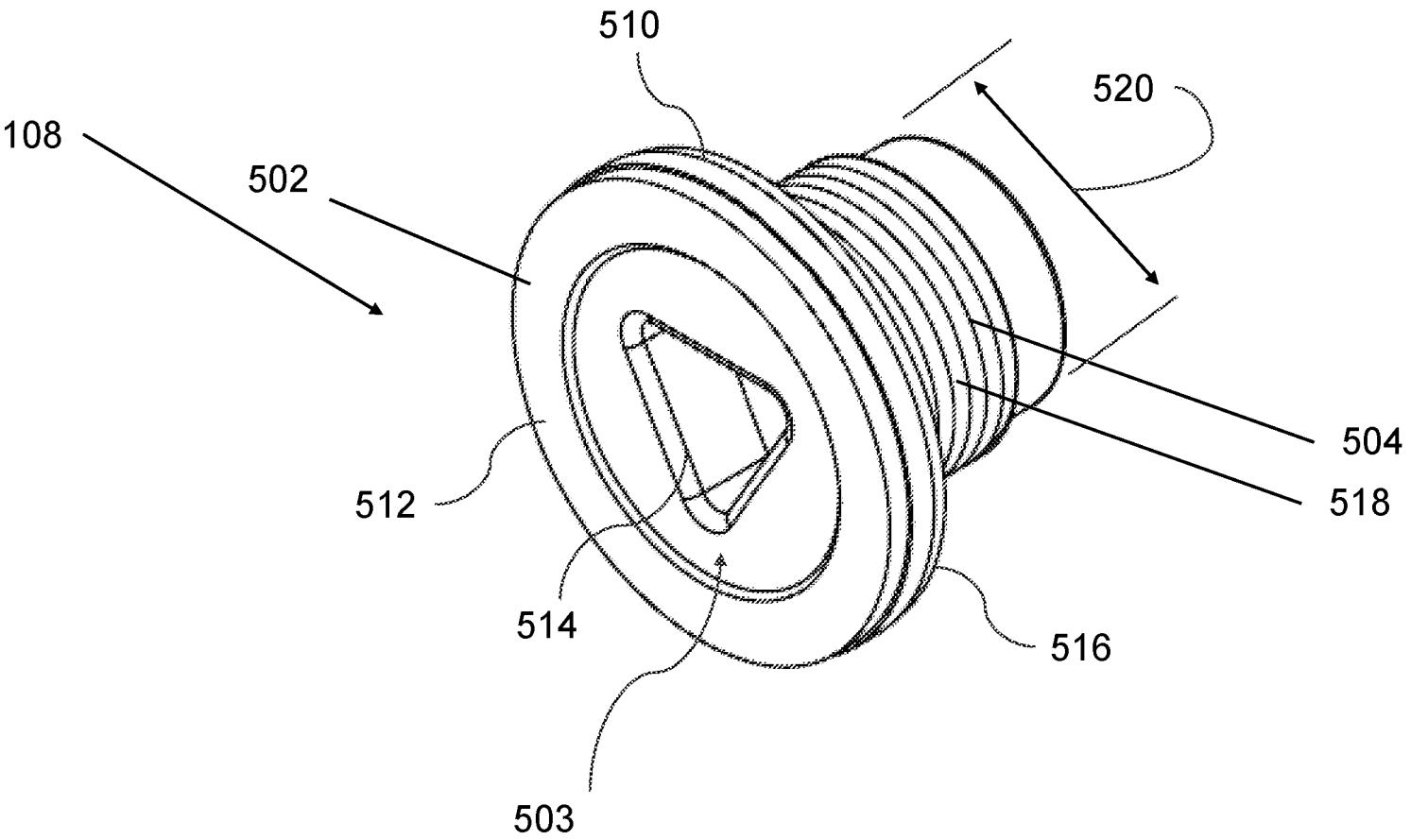
FIG. 5 is an isometric view the second fluid drain plug in accordance with the present disclosure.
Figure 6:
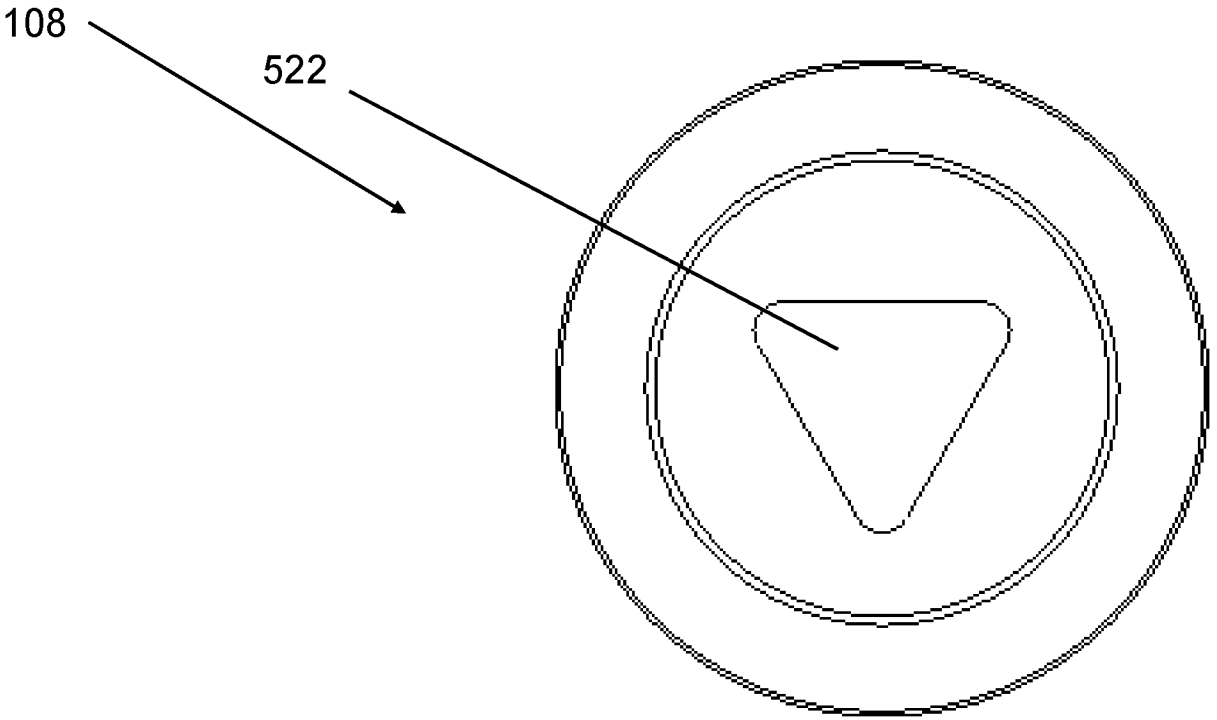
FIG. 6 is a front view of the second fluid drain plug depicted in FIG. 5.

With reference to FIGS. 5 and 6, there is illustrated a second fluid drain plug 108. The second fluid drain plug 108 has a first end 502 including a third drive feature 503 configured to be operated by the second drive feature 305 of the first fluid drain plug 110. The first end 502 includes a flange 510 having an outer surface 512 and an inner surface 516. In the depicted embodiment, third drive feature 503 is formed as a recess into outer surface 512. Inner surface 516 is configured to abut an outer rim 220 of second hole 204 when second drain plug 108 is fully inserted into second hole 204. The second fluid drain plug 108 also has a body 504 having an outside diameter 520 which is substantially similar to diameter $D_2$ of second drain hole 204. Body 504 of second fluid drain plug 108 includes threads 518 which are sized to be threaded into corresponding threads 218 formed in second drain hole 204. Specifically, third drive feature 503 includes three side surfaces 514 and a triangular end surface 522. It should be understood that in other embodiments, third drive feature 503 may have different shapes and may be formed as a protrusion from first end 502 of second fluid drain plug 108 or formed as a recess within first end 502.

In any embodiment, third drive feature 503 is formed to have a shape that mates with a corresponding shape (male or female) formed in first fluid drain plug 110 as described herein. While the third drive feature 503 of the second fluid drain plug 108 is depicted in the shape of a triangle, other embodiments may include any geometric shape such as an oval, pentagon, heptagon, octagon, a logo, alphanumeric character or numeral, or mathematic symbol or other polygon with three or more sides. The outer diameter 306 of the first drain plug 110 is a different size than the outer diameter 520 of the second fluid drain plug 108. The outer diameter 520 of the second fluid drain plug 108 is configured to be threaded into the second drain hole 204. Other embodiments may include different means of attaching the drain plug into the hole such as a press fit or adhesives.

A service technician operates the fluid drain system 100 by first removing fluid from fluid reservoir 114 by removing first drain plug 110 from first sump 206 using a standard tool to engage first drive feature 303 of first drain plug 110. It should be noted that the standard tool can only be used to engage first drain plug 110 because third drive feature 503 of second drain plug 108 is not configured to mate with a standard tool. The technician will then drain second sump 208 by inserting the second drive feature 305 of the first fluid drain plug 110 into third drive feature 503 of second drain plug 108 and removing second drain plug 108. After the fluid is drained, the process is reversed to re-install first drain plug 110 and second drain plug 108.

Figure 7:
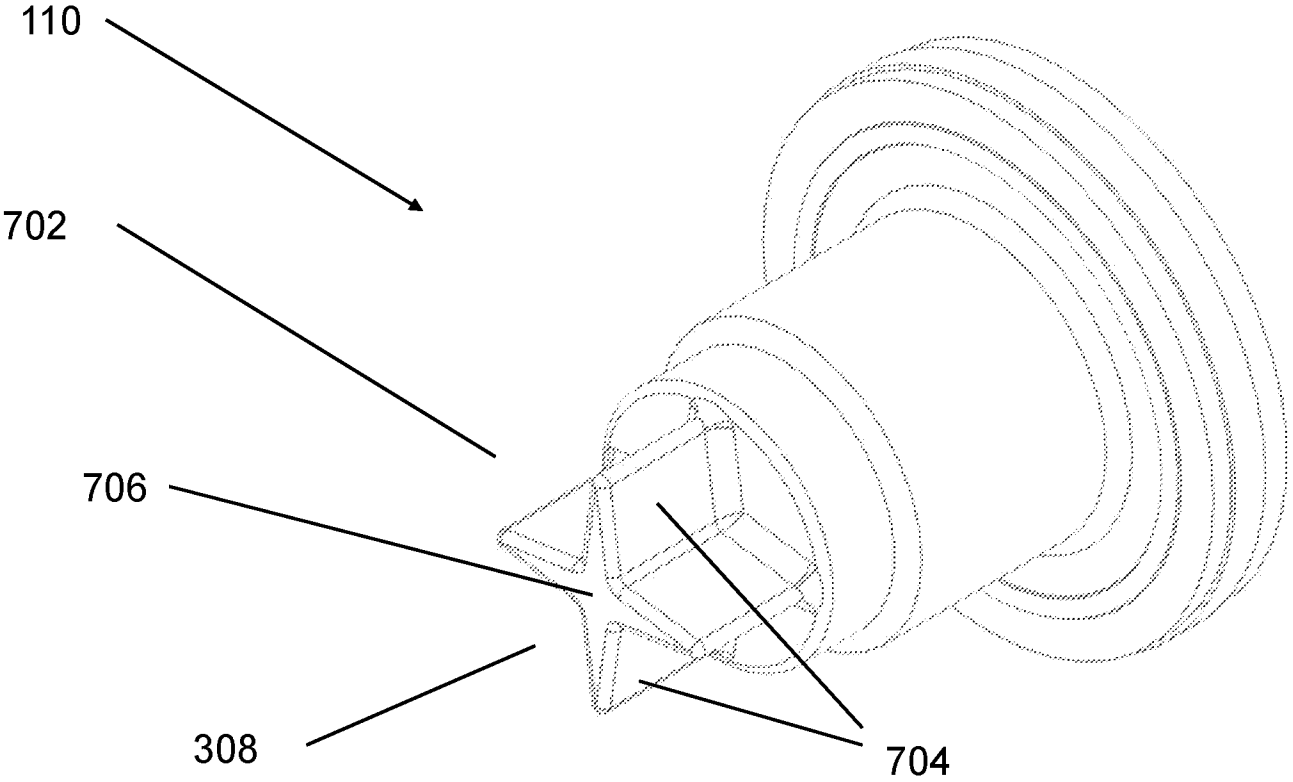
FIG. 7 is an isometric view of an alternative embodiment of the first fluid drain plug as depicted in FIG. 3.

FIG. 7 shows an alternative embodiment of the second drive feature of second end 308 of first fluid drain plug 110. In this embodiment, second drive feature 702 is formed as a plus-sign shaped protrusion. Specifically, second drive feature 702 includes four triangularly shaped protrusions 704 that form a cross or plus-sign shaped end surface 706. This embodiment has the same general structure and functionality as the other embodiments previously discussed except that the second drive feature 702 has a different shape and different dimensions. In this embodiment, third drive feature 503 of second fluid drain plug 108 is modified to correspond to second drive feature 702 (i.e., to receive second drive feature 702).

Figure 8:
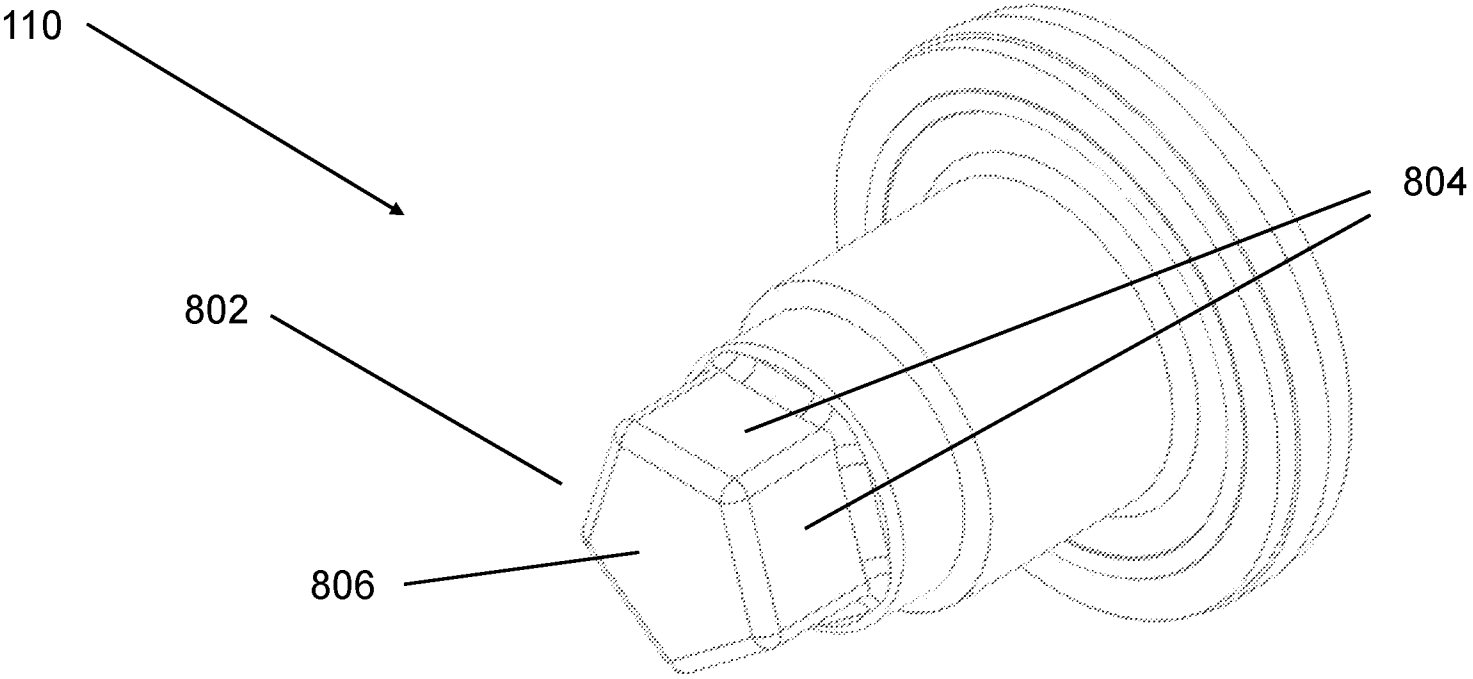
FIG. 8 is an isometric view of another alternative embodiment of the first fluid drain plug as depicted in FIG. 3.

FIG. 8 shows another alternative embodiment of the second drive feature of second end 308 of first fluid drain plug 110. In this embodiment, second drive feature 802 is formed as a pentagon shaped protrusion. Specifically, second drive feature 802 includes five outer surfaces 804 that form a hexagon shaped end surface 806. This embodiment has the same general structure and functionality as the other embodiments previously discussed except that the second drive feature 802 has a different shape and dimensions. In this embodiment, third drive feature 503 of second fluid drain plug 108 is modified to correspond to second drive feature 802 (i.e., to receive second drive feature 802).

While embodiments of the present disclosure are described with specificity, the description itself is not intended to limit the scope of this patent. Thus, the inventors have contemplated that the claimed invention might also be embodied in other ways, to include different features, or combinations of features, similar to the ones described in this document, in conjunction with other technologies.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more."

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic with the benefit of this disclosure in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

We claim:

1. A fluid drain system, comprising:

a fluid reservoir having at least two sumps including a first sump having a first hole for draining fluid from the fluid reservoir and a second sump having a second hole for draining fluid from the fluid reservoir;

a first drain plug having a first end with a first drive feature configured to be inserted into and removed out of the first hole of the fluid reservoir and a second end with a second drive feature; and a second drain plug having a first end with a third drive feature configured to be engaged by the second drive feature of the first drain plug for insertion and removal of the second drain plug into and out of the second hole of the fluid reservoir.

2. The fluid drain system of claim 1, wherein one of the first sump and the second sump has a larger fluid capacity than the other of the first sump and the second sump.

3. The fluid drain system of claim 1, wherein at least one of the first drain plug or second drain plug is made of metal.

4. The fluid drain system of claim 1, wherein the first drain plug is further configured to be operated with a tool for insertion and removal out of the first hole of the fluid reservoir:

the tool is a standard hand tool; and the second drive feature has a shape that is different from a shape of the first drive feature and disposed opposite of the first end.

5. The fluid drain system of claim 1 wherein the second drive feature of the first drain plug has a shape selected from the group consisting of a triangle, an oval, a hexagon, an octagon, a pentagon, a logo, an alphanumeric character or numeral, and a mathematic symbol.

6. The fluid drain system of claim 1 wherein the first drain plug has a first outer diameter, the second drain plug has a second outer diameter, and the first outer diameter is different from the second outer diameter.

7. The fluid drain system of claim 6, wherein the first drain plug includes a body and the second drain plug includes a body, at least one of the first drain plug body and the second drain plug body having threads configured to mate with threads formed in a corresponding one of the first hole and the second hole.

8. The fluid drain system of claim 1 wherein the first hole has a first side wall having a first inner diameter, the second hole has a second side wall having a second inner diameter, and the first inner diameter is different from the second inner diameter.

9. The fluid drain system of claim 8, wherein at least one of the first side wall and the second side wall includes threads configured to mate with threads of a corresponding one of the first drain plug and the second drain plug.

10. The fluid drain system of claim 1 further comprising:
a first marking on the first sump; and
a second marking on the second sump;
wherein the first marking and the second marking indicate an order for removal of the first drain plug and the second drain plug.

11. The fluid reservoir of claim 1 further comprising:
a first marking identifying the first sump; and
a second marking identifying the second sump.

12. The fluid drain system of claim 1, wherein the second end of the first drain plug includes side surfaces that protrude from a body of the first drain plug.

13. The fluid drain system of claim 1, wherein the first drive feature is formed as a recess into the outer surface.

14. The fluid drain system of claim 1, wherein one of the first drive feature, the second drive feature, or third drive feature is in the shape of a polygon having equal sides.

15. The fluid drain system of claim 1, wherein one of the first drive feature, the second drive feature, or third drive feature is in the shape of a polygon having unequal sides.

16. The fluid drain system of claim 1, further comprising:
a first pair of markings on the first sump; and
a second pair of markings on the second sump;
wherein the first pair of markings and the second pair of markings indicate an order for removal of the first drain plug and the second drain plug.

17. A method for changing fluids held within the fluid drain system of claim 1, comprising:
removing the first drain plug from the first hole of the reservoir;
engaging the first drain plug with the first end of the second drain plug; and
rotating the first drain plug while the first end of the first drain plug is engaged with the first end of the second drain plug to remove the second drain plug from the second hole of the reservoir.

18. The method for changing fluids of claim 17 further comprising:
identifying a first marking and a second marking on the fluid reservoir and carrying out the removing, inserting and rotating according to information provided by the first marking and the second marking.

19. The method for changing fluids of claim 17 wherein removing the first drain plug includes inserting a standard hand tool into a drive feature formed on the first drain plug.

20. The method for changing fluids of claim 17 wherein engaging the first drain plug with a first end of the second drain plug includes inserting a drive feature formed at a first end of the first drain plug into a drive feature formed at the first end of the second drain plug.

21. The method for changing fluids of claim 17, further comprising:
draining fluid from the first hole and the second hole;
rotating the first drain plug while the first drain plug is engaged with the first end of the second drain plug to insert the second drain plug into the second hole;
disengaging the first drain plug from the first end of the second drain plug; and
rotating the first drain plug while the first drain plug is disengaged from the first end of the second drain plug to insert the first drain plug into the first hole.

* * * * *